US011019686B2

(12) United States Patent
Herbstman et al.

(10) Patent No.: US 11,019,686 B2
(45) Date of Patent: May 25, 2021

(54) FLEXIBLE HEATING DEVICE

(71) Applicants: Jason Herbstman, Rocky Point, NY (US); Stephen Walker, Shoreham, NY (US)

(72) Inventors: Jason Herbstman, Rocky Point, NY (US); Stephen Walker, Shoreham, NY (US)

( * ) Notice: Subject to any disclaimer, the term of this patent is extended or adjusted under 35 U.S.C. 154(b) by 425 days.

(21) Appl. No.: 15/664,678

(22) Filed: Jul. 31, 2017

(65) Prior Publication Data

US 2019/0037648 A1 Jan. 31, 2019

(51) Int. Cl.

| | |
|---|---|
| ***H05B 1/02*** | (2006.01) |
| ***H05B 3/34*** | (2006.01) |
| *A61H 19/00* | (2006.01) |

(52) U.S. Cl.

CPC ..... *H05B 3/342* (2013.01); *H05B 1/0225* (2013.01); *A61H 19/00* (2013.01); *A61H 2201/0192* (2013.01); *A61H 2201/0207* (2013.01); *A61H 2201/0221* (2013.01); *A61H 2201/1207* (2013.01); *A61H 2201/50* (2013.01); *H05B 2203/015* (2013.01)

(58) Field of Classification Search

CPC ..... H05B 3/342; H05B 3/34; H05B 1/0225; H05B 2203/015; A61K 19/00; A61H 2201/0207; A61H 19/44; A61H 19/50

USPC ..... 219/491, 494, 528, 535, 529, 545

See application file for complete search history.

(56) References Cited

U.S. PATENT DOCUMENTS

| | | | | |
|---|---|---|---|---|
| 4,065,660 | A * | 12/1977 | Berard | A47J 36/2433 219/386 |
| 5,105,067 | A * | 4/1992 | Brekkestran | G05D 23/2401 2/69 |
| 6,582,456 | B1 * | 6/2003 | Hand | A61F 7/007 219/212 |
| 6,723,967 | B2 * | 4/2004 | Rock | A41D 13/0051 219/528 |
| 6,870,135 | B2 * | 3/2005 | Hamm | A47J 36/2433 219/202 |
| 8,809,751 | B2 * | 8/2014 | Ellis | F16L 53/008 219/535 |
| 2009/0008008 | A1 * | 1/2009 | Kuo | A63B 47/005 150/160 |
| 2012/0273479 | A1 * | 11/2012 | Kim | H05B 3/342 219/494 |
| 2014/0353200 | A1 * | 12/2014 | Samain | A61K 8/31 206/524.1 |

FOREIGN PATENT DOCUMENTS

| | | | | |
|---|---|---|---|---|
| FR | 2924299 | * | 11/2007 | H05B 1/02 |

* cited by examiner

*Primary Examiner* — Mark H Paschall

(74) *Attorney, Agent, or Firm* — Carter, DeLuca & Farrell LLP

(57) ABSTRACT

A flexible heating device includes a pouch defined in-part by a flexible heating textile that defines a cavity. The size of the cavity defined by the pouch is adjustable to snugly receive objects, e.g., sex toys, of different sizes. In embodiments, the pouch supports closing structure to facilitate adjustment of the size of the cavity to accommodate different size objects. In embodiments, the flexible heating textile includes an adapter that receives power from a power source such as a battery or wall plug to heat the flexible heating textile.

19 Claims, 3 Drawing Sheets

FLEXIBLE HEATING DEVICE

BACKGROUND

1. Technical Description

The present disclosure is directed to a flexible heating device and, more particularly, to a flexible heating device for heating objects including but not limited to sex toys.

2. Background of Related Art

The sex toy industry is a multi-billion dollar industry. In fact, worldwide sales of sex toys are predicted to reach fifty-two (52) billion dollars by the year 2020. Some of the most popular sex toys include vibrators, dildos and the like. These toys are available in a variety shapes, sizes, and materials. During use of these toys, users are known to heat the toy to a temperature at or above body temperature to increase pleasure derived from the toy. This has been accomplished in variety of ways including placing the sex toy in warm water or against a body surface.

A continuing need exists in the sex toy art for a heating device that is capable of heating sex toys of a variety of different sizes in a fast and efficient manner.

SUMMARY

One aspect of the disclosure is directed to a flexible heating device including a pouch and a power source. The pouch defines a cavity and is formed from a flexible heating textile. Closing structure is provided on the pouch for adjusting the size of the cavity. The power source communicates with the flexible heating textile to supply power to the flexible heating textile to increase a temperature of the flexible heating textile and of the object supported within the cavity.

In embodiments, a timer and an on/off switch are positioned between the power source and the pouch to selectively control the supply of power to the pouch.

In some embodiments, a thermostat is positioned between the power source and the pouch to selectively control the temperature of the flexible heating textile.

In certain embodiments, the pouch includes an outer layer formed of neoprene or similar material that is secured to the flexible heating textile.

In embodiments, the pouch includes an inner layer formed of a spandex type fabric.

In some embodiments, the closing structure is selected from the group consisting of hook and loop fasteners, laces, straps, and buckles.

In certain embodiments, an adapter is supported by the pouch and is configured to communicate with the power supply.

In embodiments, the pouch has an open end and a closed end.

In some embodiments, the pouch defines a slit that extends from the open end of the pouch towards the closed end of the pouch and the closing structure extends from a first portion of the pouch on one side of the slit, across the slit, to a second portion of the pouch on the other side of the slit.

In certain embodiments, the slit is positioned to allow the first portion of the pouch to overlap the second portion of the pouch to change the size of the cavity.

In some embodiments, the timer and the thermostat are adapted to be controlled wirelessly.

In some embodiments, the flexible heating textile includes a conductive yarn including a core yarn and at least one rolled metal wire spirally wound around the core yarn.

In certain embodiments, the rolled metal wire includes an oxidation and corrosion resistant coating.

Another aspect of the disclosure is directed to a method of heating an object including placing the object into a cavity of a pouch that is formed of a flexible heating textile; using closing structure attached to the pouch to reduce the size of the cavity such that the object is snugly received within the pouch; and supplying power to the flexible heating textile to heat the flexible heating textile and the object positioned within the cavity.

In some embodiments, the method includes setting a temperature of the flexible heating textile using a thermostat.

In certain embodiments, the method includes setting a timer to control a duration of heating of the flexible heating textile.

BRIEF DESCRIPTION OF THE DRAWINGS

Various embodiments of the presently disclosed flexible heating device are described herein below with reference to the drawings, wherein.

DETAILED DESCRIPTION OF EMBODIMENTS

Figure 1:
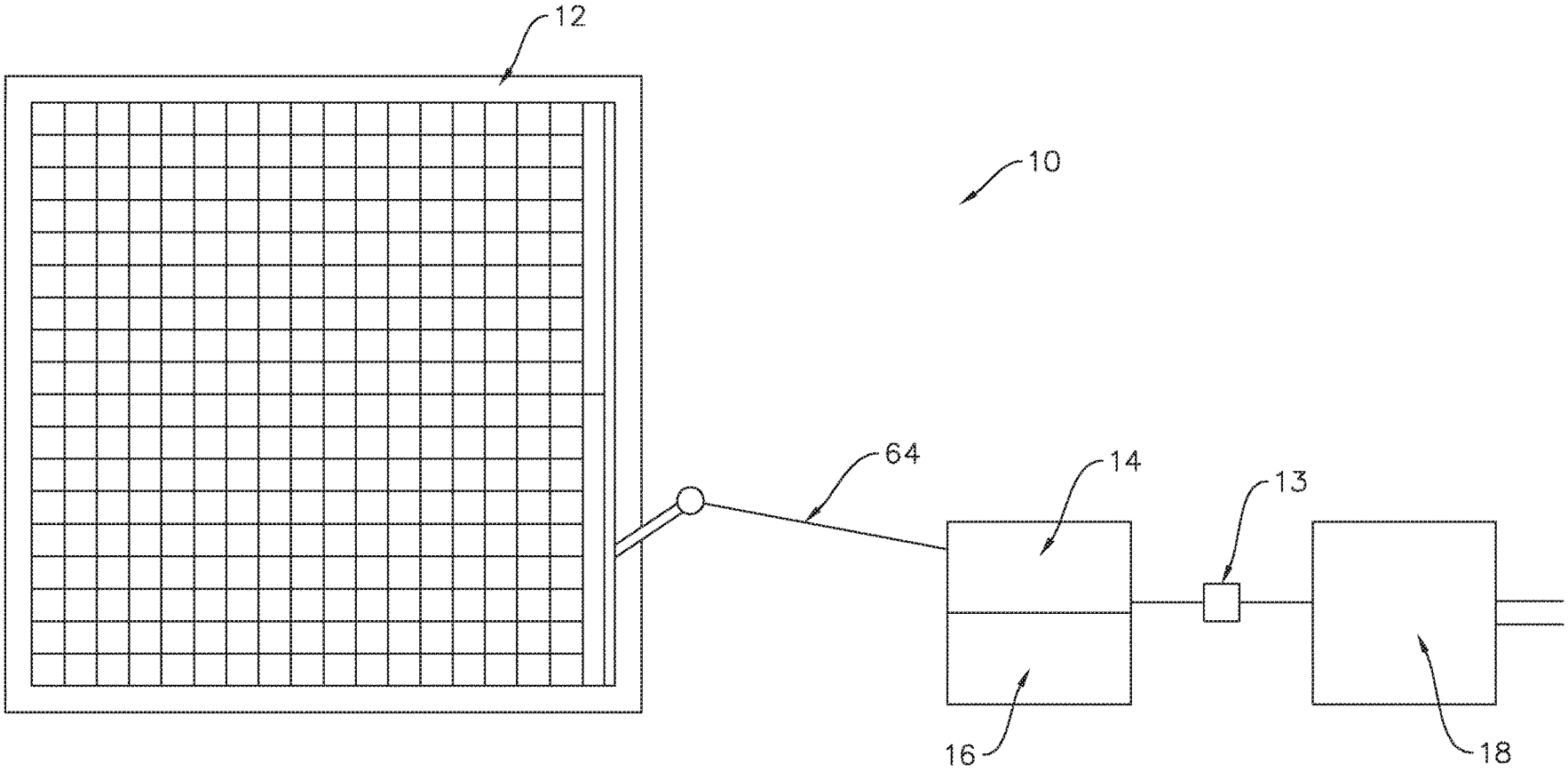
FIG. 1 is a schematic view of an exemplary embodiment of the presently disclosed flexible heating device.

The presently disclosed flexible heating device will now be described in detail with reference to the drawings in which like reference numerals designate identical or corresponding elements in each of the several views. However, it is to be understood that the disclosed embodiments are merely exemplary of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure.

The presently disclosed flexible heating device includes a pouch that defines a cavity. The pouch is formed at least in part by a flexible heating textile. The size of the cavity defined by the pouch is adjustable such that objects of different sizes, e.g., sex toys, can be snugly or tightly received within the pouch. In embodiments, the pouch supports closing structure such as one or more laces, straps, buckles, or hooks and loop fasteners, e.g., Velcro™, to facilitate adjustment of the size of the cavity to accommodate the different size objects. In embodiments, the flexible heating textile includes an adapter that receives power from a power source such as a battery or wall outlet to heat the flexible heating textile. In some embodiments, a circuit including a timer and a thermostat is provided between the power source and the pouch to automatically control operation of the flexible heating device and the temperature of the flexible heating textile.

FIG. 1 illustrates a schematic diagram of the presently disclosed flexible heating device which is shown generally as 10. The flexible heating device 10, as illustrated, includes a pouch 12, an on/off switch 13, a timer 14, a thermostat 16, and a power source 18. The power source may be in the form of a wall plug or battery pack. In some embodiments, the power source 18 includes a rectifier for converting alternating current (AC) to direct current (DC) as discussed in further detail below.

Figure 2:
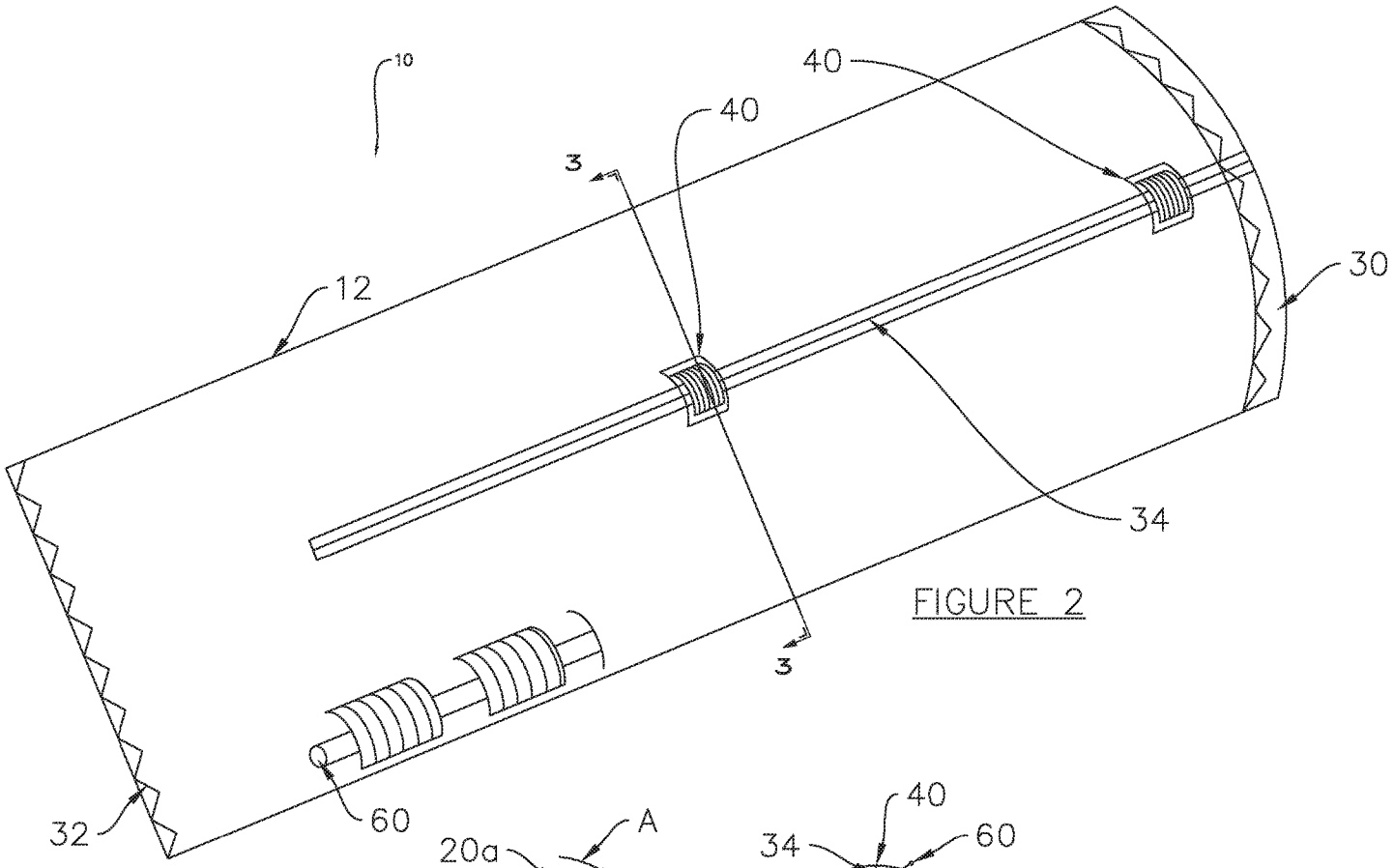
FIG. 2 is a perspective view of an exemplary embodiment of a pouch of the flexible heating device shown in FIG. 1.
Figure 3:
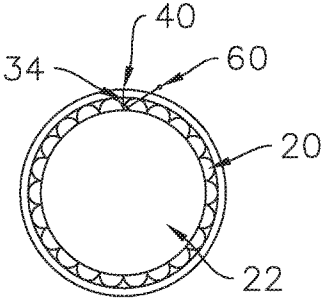
FIG. 3 is a cross-sectional view taken along section line 3-3 of FIG. 2.
Figure 4:
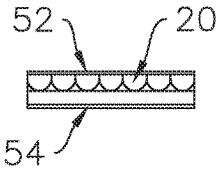
FIG. 4 is a sectional view taken through a heating fabric used to construct the pouch of the flexible heating device shown in FIG. 1.

Referring to FIGS. 2-4, the pouch 12 is formed from a flexible heating textile 20 that is configured to define a cavity 22 that is dimensioned to receive objects of different sizes such as sex toys. In embodiments, the flexible heating textile 20 can be a conductive yarn such as described in U.S. Patent Publication No. 2010/0300060 ("'060 Publication") which is incorporated herein in its entirety by reference. The conductive yarn includes a core yarn and at least one rolled metal wire which is spirally wound around the core yarn. In embodiments, the rolled metal wire includes a coating to provide corrosion and oxidation protection. The conductive yarn is capable of withstanding dyeing, finishing, and washing and has excellent stress resistance, conductivity, softness and flexibility. Alternately, other known heating textiles can be used to form the pouch 12.

The pouch 12 has a first end 30 and a second end 32. In some embodiments, the first end defines an opening that is dimensioned to receive the object to be heated, e.g., a sex toy, and the second end 32 is closed. The closed end 32 can be sealed by securing upper and lower layers of the flexible heating textile 20 to each other such as by stitching, welding, snaps, hooks and loop fasteners, or the like. Alternately, the closed end 32 need not be closed but can remain open.

Figure 5:
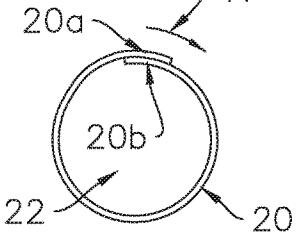
FIG. 5 is a cross-sectional view of the pouch of the flexible heating device shown in FIG. 1 with the pouch adjusted to reduce a size of a cavity defined by the pouch.

In some embodiments, the pouch defines a longitudinal slit 34 that extends from the first end 30 towards the second end 32. The longitudinal slit 34 allows a first layer 20*a* of the flexible heating textile 20 to be moved over an opposing layer 20*b* of fabric in the direction indicated by arrow A in FIG. 5 to reduce the size and/or diameter of the cavity 22 defined by the flexible heating textile 20. In some embodiments, the pouch 12 also supports closing structure 40 that can be tightened about the pouch 12 to limit outward expansion of the cavity 22. The closing structure 40 can be in the form of hooks and loop fasteners, laces, buckles, straps or the like. The closing structure 40 extends from one side of the pouch 12, across the longitudinal slit 34, to the other side of the pouch 12 and can be tightened to secure the pouch 12 snugly or tightly about the object supported within the cavity of the pouch 12.

Referring to FIG. 4, in embodiments, the flexible heating textile 20 is sandwiched between an inner layer 52 formed of a synthetic fiber or fabric such as a spandex type fabric and an outer layer 54 formed of synthetic rubber such as neoprene with a synthetic fiber or fabric such as spandex attached thereto to form the exterior of the pouch 12. Alternately, other materials of construction are envisioned. In embodiments, the spandex type fabric and/or the neoprene layers of material can be secured to the inner and outer layers of the flexible heating fabric using adhesives or the like. The outer layer 54 should have insulated properties to retain heat within the cavity 22 of the pouch 12.

In embodiments, the pouch 12 supports an adapter 60 that is in electrical communication with the flexible heating fabric 20 such as the conductive yarn described in the '060 Publication. The adapter 60, which may be located on a lower side or the closed end 32 of the pouch 12, can be a standard 12 volt jack or any other type of known electrical connector for delivering AC or DC current to the flexible heating fabric 20. The adapter 60 communicates with the power source 18 via wires 64, and optionally the on/off switch, the timer 14, and/or the thermostat 16, to deliver power to the flexible heating fabric 20. Upon receipt of power, the temperature of the flexible heating fabric can be selectively increased to a desired temperature.

In use, an object such as a sex toy can be placed within the cavity 22 defined by the pouch 12 and the closing structure 40 can be tightened to secure the object snugly within the cavity 22. Next, the power source 18 can be connected to the adapter 60 to deliver power to the flexible heating fabric 20. The temperature of the flexible heating textile 20 and thus the object supported within the cavity 22 of the pouch 12 can be selectively controlled using the thermostat 16. Similarly, the duration of heating can be controlled using the timer 14.

It is envisioned that in some embodiments the timer 14 and thermostat 16 can be controlled wirelessly with a smart phone or wireless transmitter. It is also envisioned that the pouch 12 can be of a variety of different sizes or include one or more cavities. For example, the pouch 12 can be formed with one or more dividers positioned within the cavity to divide the cavity 22 into multiple compartments. Each of the compartments may be dimensioned to receive objects of a variety of different sizes. It is also envisioned that the pouch need not include closing structure but rather can be configured to receive objects of a particular size or size range.

Figure 7:
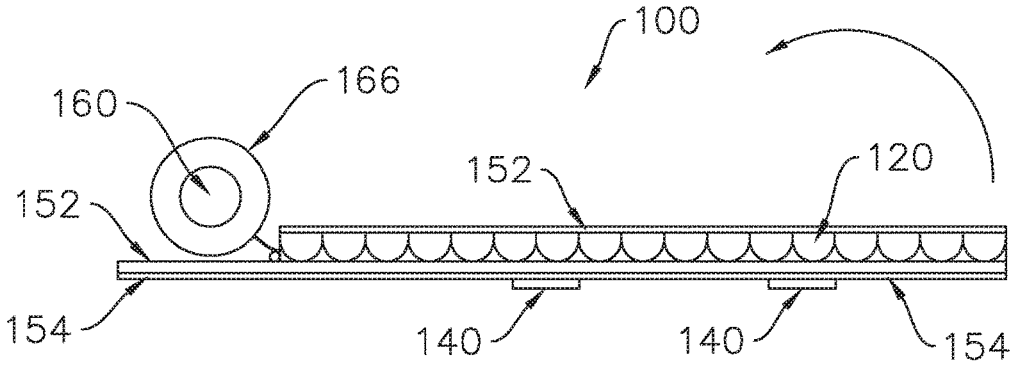
FIG. 7 is a side schematic view of the flexible heating device shown in FIG. 6.
Figure 6:
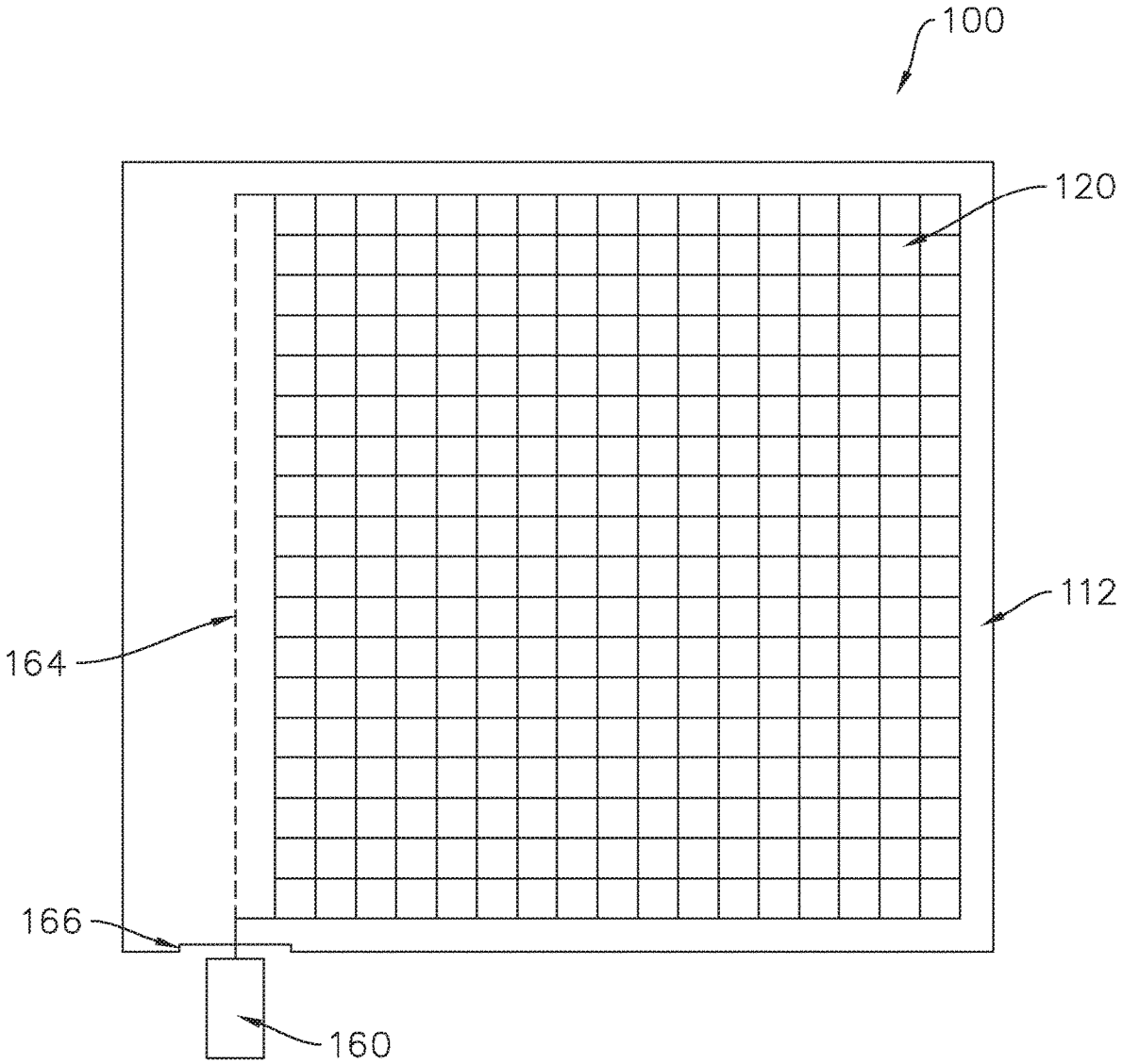
FIG. 6 is a schematic view of another exemplary embodiment of the presently disclosed the flexible heating device.

FIGS. 6 and 7 illustrate an alternative embodiment of the presently disclosed flexible heating device shown generally as 100. The flexible heating device 100 is substantially similar to the flexible heating device 10 except that the flexible heating device 100 is in the form of a flexible pad 112 and does not form a pouch. The flexible heating device 100 includes a flexible heating textile 120 as described above in regard to the flexible heating textile 20. In embodiments, the flexible heating textile 120 is sandwiched between an inner layer 152 formed of a synthetic fiber or fabric such as a spandex type fabric and an outer layer 154 formed of synthetic rubber such as neoprene with a synthetic fiber or fabric such as spandex attached thereto to form the exterior of the flexible pad 112. Alternately, other materials of construction are envisioned. In embodiments, the spandex type fabric and/or the neoprene layers of material can be secured to the inner and outer layers of the flexible heating fabric using adhesives or the like.

It is envisioned that in certain embodiments a round or half round cap 166 will be positioned at the bottom of the flexible pad 112, and the adapter 160, with internal wiring from the textile 120, will exit the flexible pad 112 via the cap 166. The flexible pad 112 may also include closing structure 140 that can be used to tightly wrap the flexible pad 112 about an object to be heated. As discussed above in regard to the flexible heating device 10, the closing structure 140 can be in the form of hooks and loop fasteners, laces, buckles, straps or the like.

When an object such as a sex toy is placed onto the flexible pad 112, the flexible pad 112 can be wrapped about the object to be heated. Next, the closing structure 140 can be tightened to tightly secure the flexible pad 112 about the object. Although not shown in FIGS. 6 and 7, the flexible heating device 110 may also include an on/off switch, a timer, a thermostat, and a power source such as described above in regard to the flexible heating device 10. Thereafter, the power source can be communicated with the flexible pad 112 to heat the flexible pad 112 and the object wrapped within the flexible pad.

Persons skilled in the art will understand that the devices and methods specifically described herein and illustrated in the accompanying drawings are non-limiting exemplary embodiments. It is envisioned that the elements and features illustrated or described in connection with one exemplary embodiment may be combined with the elements and features of another without departing from the scope of the present disclosure. As well, one skilled in the art will appreciate further features and advantages of the disclosure based on the above-described embodiments. Accordingly, the disclosure is not to be limited by what has been particularly shown and described, except as indicated by the appended claims.

What is claimed is:

1. A flexible heating device comprising:

a flexible heating textile including closing structure for securely fastening the flexible heating textile about an object to be heated, the flexible heating textile being in the form of a pouch defining a cavity and the closing structure configured to adjust a size of the cavity;

wherein the pouch includes an outer layer formed of neoprene that is secured to the flexible heating textile and an inner layer formed of a spandex type fabric, the inner layer defining the cavity of the pouch; and a power source communicating with the flexible heating textile, the power source supplying power to the flexible heating textile to increase a temperature of the flexible heating textile;

wherein the pouch has an open end and a closed end and defines a slit that extends from the open end of the pouch towards the closed end of the pouch and the closing structure extends from a first portion of the pouch on one side of the slit, across the slit, to a second portion of the pouch on the other side of the slit.

2. The flexible heating device of claim 1, further including a timer positioned between the power source and the pouch, the timer being provided to selectively control the supply of power to the pouch.

3. The flexible heating device of claim 2, further including an on/off switch communicating with the timer.

4. The flexible heating device of claim 2, further including a thermostat positioned between the power source and the pouch to selectively control the temperature of the flexible heating textile.

5. The flexible heating device of claim 1, wherein the closing structure is selected from the group consisting of hooks and loop fasteners, laces, straps, and buckles.

6. The flexible heating device of claim 1, further including an adapter supported by the pouch, the adapter being configured to communicate with the power supply.

7. The flexible heating device of claim 1, wherein the slit is positioned to allow the first portion of the pouch to be positioned atop the second portion of the pouch to change the size and/or diameter of the cavity.

8. The flexible heating device of claim 4, wherein the timer and the thermostat are adapted to be controlled wirelessly.

9. The flexible heating device of claim 1, wherein the flexible heating textile includes a conductive yarn including a core yarn and at least one rolled metal wire spirally wound around the core yarn.

10. The flexible heating device of claim 1, wherein the rolled metal wire includes a coating that is resistant to oxidation and corrosion.

11. A flexible heating device comprising:

a flexible heating textile including closing structure for securely fastening the flexible heating textile about an object to be heated, the flexible heating textile being in the form of a pouch defining a cavity and the closing structure configured to adjust a size of the cavity;

the pouch including an outer layer formed of neoprene that is secured to the flexible heating textile and an inner layer formed of a spandex type fabric, the inner layer defining the cavity of the pouch; and an adapter configured to be coupled to a power source to supply power to the flexible heating textile to increase a temperature of the flexible heating textile;

wherein the pouch has an open end and a closed end and defines a slit that extends from the open end of the pouch towards the closed end of the pouch and the closing structure extends from a first portion of the pouch on one side of the slit, across the slit, to a second portion of the pouch on the other side of the slit.

12. The flexible heating device of claim 11, further including a timer positioned between the power source and the pouch, the timer being provided to selectively control the supply of power to the pouch.

13. The flexible heating device of claim 12, further including an on/off switch coupled to the adapter.

14. The flexible heating device of claim 12, further including a thermostat positioned between the adapter and the pouch to selectively control the temperature of the flexible heating textile.

15. The flexible heating device of claim 11, wherein the closing structure is selected from the group consisting of hooks and loop fasteners, laces, straps, and buckles.

16. The flexible heating device of claim 11, wherein the pouch has an open end and a closed end.

17. The flexible heating device of claim 11, wherein the slit is positioned to allow the first portion of the pouch to be positioned atop the second portion of the pouch to change the size and/or diameter of the cavity.

18. The flexible heating device of claim 14, wherein the timer and the thermostat are adapted to be controlled wirelessly.

19. The flexible heating device of claim 11, wherein the flexible heating textile includes a conductive yarn including a core yarn and at least one rolled metal wire spirally wound through the core yarn.

* * * * *